United States Patent [19]

Applegate et al.

[11] 4,413,919

[45] Nov. 8, 1983

[54] RIBBON LOADING SYSTEM FOR PRINTERS

[75] Inventors: Steven L. Applegate; James J. Molloy, both of Lexington, Ky.

[73] Assignee: International Business Machines Corporation, Armonk, N.Y.

[21] Appl. No.: 315,591

[22] Filed: Oct. 30, 1981

[51] Int. Cl.[3] ..... B41J 32/00; B41J 33/12; B41J 35/08; B41J 33/52

[52] U.S. Cl. ..... 400/208; 400/234; 242/194

[58] Field of Search ..... 400/207, 208, 208.1, 400/234, 206.3, 206.4; 242/193, 194, 198

[56] References Cited

U.S. PATENT DOCUMENTS

| | | | |
|---|---|---|---|
| 2,951,654 | 9/1960 | Steelman | 242/198 |
| 3,804,227 | 4/1974 | Cappotto et al. | 400/234 |
| 4,083,444 | 4/1978 | Salto | 400/208 |
| 4,310,257 | 1/1982 | Field et al. | 400/208 |
| 4,339,210 | 7/1982 | Craft et al. | 400/208 |

*Primary Examiner*—William Piephz

*Attorney, Agent, or Firm*—John A. Brady; George E. Grosser

[57] ABSTRACT

A ribbon loading system for a printer utilizes a ribbon cartridge that includes a container enclosing two coaxially arranged ribbon reels. By providing flexible blades in the floor of the container, the reels are urged toward a top cover where relative movement is restrained. Upon loading of the cartridge, camming arms enter apertures in the container and are moveable to a clamping position to draw the blades from the ribbon reels and allow free rotational movement.

For a presently preferred implementation, the structure including the camming arms is coupled through linkages to clear the ribbon threading path and thereby facilitate ribbon insertion.

18 Claims, 6 Drawing Figures

RIBBON LOADING SYSTEM FOR PRINTERS

BACKGROUND OF THE INVENTION

Technical Field of the Invention

The present invention relates to ribbon cartridges for printers and more specifically to systems for mounting such cartridges on the printer.

Art Discussion

Ribbon cartridges greatly facilitate the mounting of a ribbon on a printer by eliminating all or most of the unpleasant tasks of threading the ribbon along the ribbon path. This advantage is quickly compromised, however, if ribbon pulls loose from the cartridge during handing to produce a frustrating tangle. For printers that cause electrodes to sweep across the ribbon during printing, there is, additionally, raised the possibility of damaging the printhead if a crimp or twist is inadvertently formed in the ribbon as a result of handling.

To avoid problems that might arise if a ribbon threading loop is accidentally pulled, it is desirable to prevent ribbon release during handling while nonetheless allowing normal movement during printing. Such restraining of the ribbon is desirably achieved with little cost added to the cartridge and should be easily disabled upon mounting of the cartridge.

BRIEF SUMMARY OF THE INVENTION

In a ribbon cartridge with first and second coaxial ribbon reels, flexible blades formed in the floor of the cartridge urge the reels together and against a top cover to constrain the reels from moving.

Preferably, a reel surface adjacent the top cover includes shaped projections that mate with corresponding projections of the inner top cover surface to restrain rotational reel movement. By so constraining the reels, shifting of the reels within the reel container of the cartridge is prevented and there is reduced likelihood of breakage if the cartridge is dropped or otherwise abused.

During mounting to a support frame, hook-like arms of a rotatable loading member enter apertures in the base of the cartridge and engage the resilient blades with camming edges that, upon rotation of the loading member to a clamping position, drive the projecting portions of the blades toward the cartridge floor, thereby releasing the reels to drop to their normal operative positions where they rotate freely. By so controlling the resilient blades, the arms serve not only to release the reels but also hold the cartridge firmly against the support frame.

For a preferred implementation of the invention, the loading member is also connected through linkages so that, when rotated to the load position, tension control and ribbon drive instrumentalities that nip the ribbon during printer operation are drawn to locations where they do not interfere with the ribbon threading path defined by guide arms of the cartridge. Upon rotation of the loading member to the operating position, the tension and drive instrumentalities are freed to redefine the ribbon path for normal printing operation.

BRIEF DESCRIPTION OF THE DRAWING

The invention will be described in detail with reference to the drawing wherein.

DETAILED DESCRIPTION OF THE INVENTION

Figure 1:
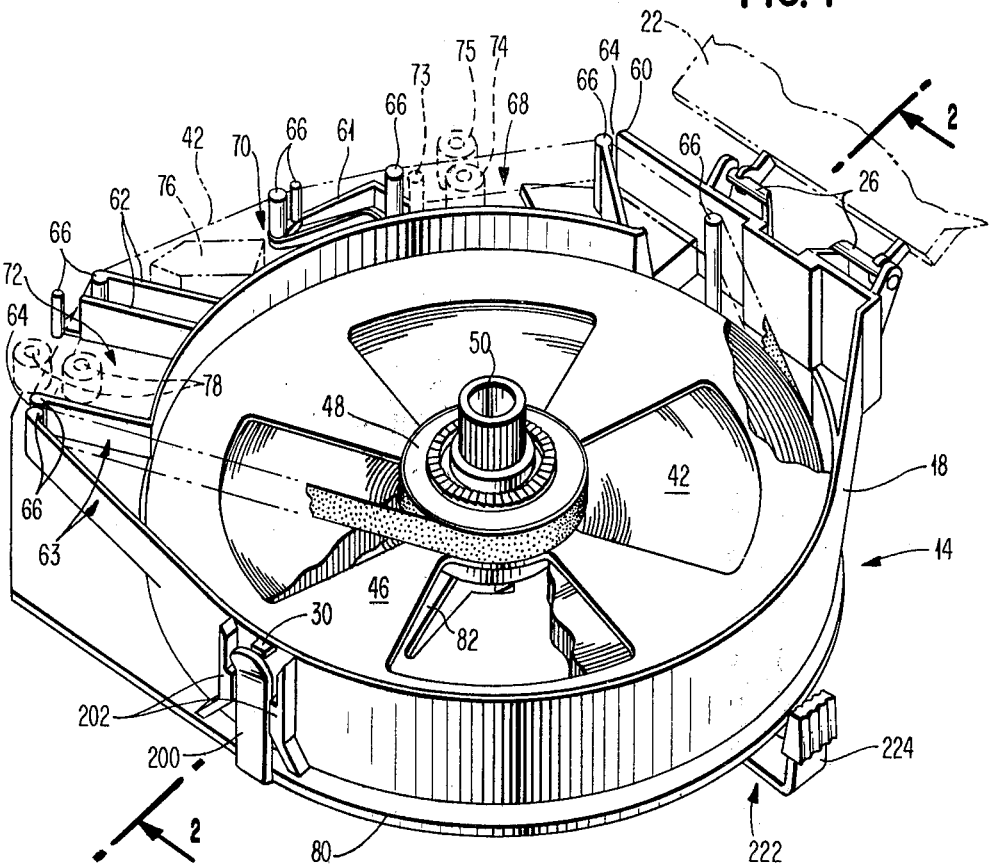
FIG. 1 is a perspective view of a cartridge according to the invention mounted on a support.
Figure 2:
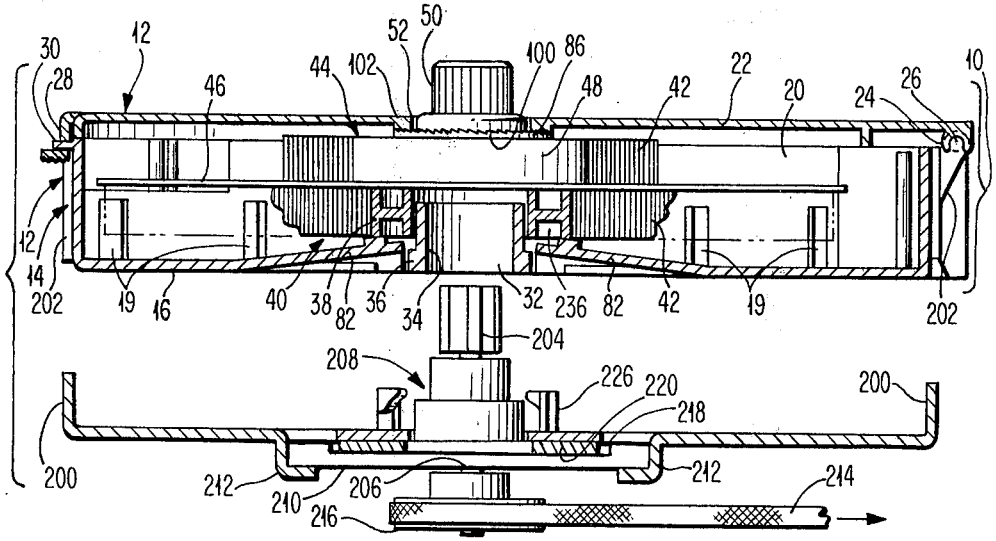
FIG. 2 is a cross-sectional view taken as indicated by the line 2—2 in FIG. 1.

Referring to FIGS. 1 and 2, a ribbon cartridge generally denoted 10 includes a container 12 that is preferably molded of high impact strength polystyrene. The container 12 has a base section 14 that includes a generally planar floor 16 and a sidewall 18. A ribbon chamber 20 is defined by the base section 14 in conjunction with a cover 22 that is received on the sidewall 18.

To permit access to the ribbon chamber 20, the cover 22 may be hinge mounted by hinge members 24 and 26, so as to be fastenable to the sidewall 18 using cooperating latch members 28 and 30. Alternatively, the cover 22 may be bonded or fixed by other permanent means to be integral with the sidewall 18 to provide a substantially sealed container 12.

A drive aperture 32 is defined in the floor 16 by a cylindrical bearing projection 34 having a collar 36 adjacent the floor 16. Arranged to slip over and rotate on the cylindrical bearing projection 34 is a core 38 of a first reel 40 for a ribbon 42 (preferably a supply reel). Also arranged in the chamber 20 is a second reel 44 (preferably a takeup reel) that includes flange 46 and a core 48 that is coaxial with and is rotatable on the core 38. Extending axially from the center of the core 48 is a cylindrical knob 50 that projects through the cover 22 at an aperture defined by the edge 52 to permit operator access for manually rotating the second reel 44.

Projecting guide structures 60, 61, 62 and 63 (see FIG. 1) are molded into the container 12 in rigid channel-like shapes and serve to guide the ribbon 42 along a threading path extending from reel 40 to reel 44. Supported on the arms 60–63 are plural rounded guide surfaces 66 that contact the ribbon to define the threading path which includes apertures 64 in the sidewall 18 that allow a loop of the ribbon 42 to extend externally of the ribbon chamber 20. The arms 60–63 define three ribbon access windows 68, 70 and 72 along the ribbon threading path at which the ribbon 42 is exposed on all sides, for example, to interact with printer instrumentalities such as a tension brake 74 (with cooperating shock roller 73 and pressure roller 75), a printhead 76, and a pair of drive rollers 78 (these elements are not shown in FIG. 2) which are mounted to a support frame 80.

Figure 3:
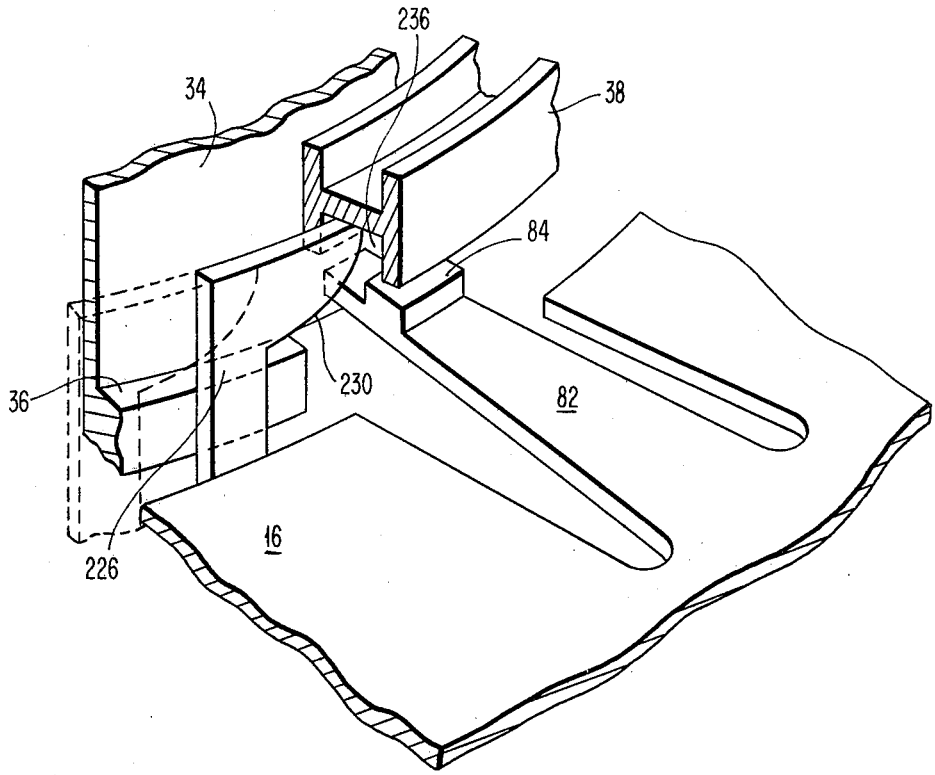
FIG. 3 is a cutaway perspective view emphasizing instrumentalities cooperating with resilient blades according to the invention.

According to the invention, one or more resilient blades 82 are arranged on the floor 16 of the container 12 (see also FIG. 3) to enter the ribbon chamber 20 with an inclination toward the bearing projection 34 so as to urge against the core 38 of the first reel 40. A pad 84 on each blade 82 is located to establish engagement with the core 38 at the outer periphery. Preferably, a pair of resilient blades 82 are provided to balance forces about the axis of the core 38 and, to achieve low cost, the resilient blades 82 are molded as a part of the base section 14.

Figure 4:
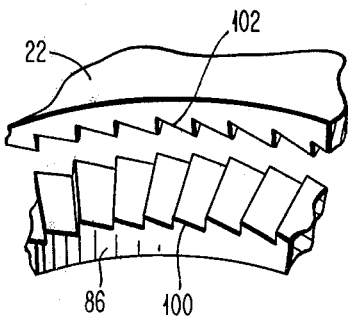
FIG. 4 is a cutaway perspective view emphasizing the mating cover and reel surfaces according to the invention.

At the surface of core 48 adjacent the cover 22 a circular ridge 86 coaxial with the core 48 is provided with a series of irregularities such as projections 100 (see FIG. 4) that are shaped to mate with corresponding projections 102 formed on the inner surface of the cover 22.

The projections 100 and 102 are preferably asymmetrical angled teeth that, when mating, offer moderate resistance to rotation of the core 48 for a rotation direction to wind the ribbon 42 onto the reel 44 (counterclockwise as viewed in FIG. 1). For the direction corresponding to unwinding of the ribbon 42 from reel 44, the projections 100 and 102 interfere, for the preferred implementation, preventing rotation.

Now considering mounting of the cartridge 10 on the support 80, two tabs 200 are positioned to cooperate in two sets of guide ridges 202 to promote a proper orientation. A ribbed drive key 204 (see FIG. 2) is positioned relative to tabs 200 for entering the drive aperture 32 and extends into a mating recess (not shown) of the core 48 to establish a drive connection. The ribbed drive key 204 is mounted to a shaft 206 that is supported in a bearing 208.

For mounting, the bearing 208 is preferably formed (e.g. using an acetal plastic) to be integral with a flange 210 that is constrained in tabs 212 of the support frame 80. Rotational motion is provided by a drive system (not shown) through a cable 214 that wraps around a pulley 216 which is connected to rotate with the shaft 206. The flange 210 has a recess 218 that encircles the bearing 208 and receives a washer-like pivot section 220 (see also FIG. 6) of a loading member 222 that includes a handle 224 and preferably two projecting arms 226 (one for each resilient blade 82).

Figure 5:
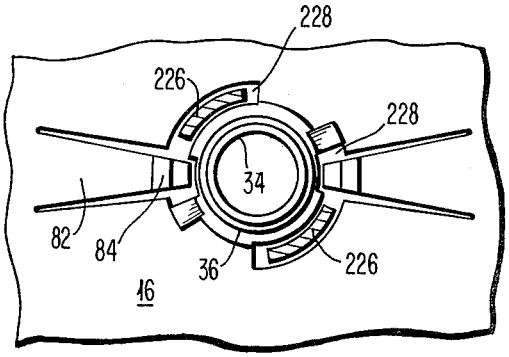
FIG. 5 is a partial plan view indicating the position of loading arms in apertures defined in the floor of a cartridge according to an aspect of the invention.

For a "load" position of the loading member 222, the arms 226 are positioned (see also FIG. 5) to enter a pair of corresponding apertures 228 formed in the floor 16 of the base section 14 adjacent the collar 36. Referring again to FIG. 3, interaction results when the arms 226 are rotated from the "load" position (phantom) to a "clamp" position to cause a camming edge 230 to drive the resilient blades 82 toward the floor 16. With the resilient blades 82 depressed, the reels 40 and 44 are free to move toward the floor 16 reducing the friction therebetween and disengaging the projections 100 and 102 to allow free rotation relative to the cover 22. To further reduce friction between the two spools, reel 44 comes to rest atop bearing projection 34 while reel 40 rests against collar 36, the spacing being such that the spools are separated from one another. Also, shoulder projections 19 are formed in the chamber 20 to prevent the ribbon 42 from slipping over the edge of the flange 46.

According to a special aspect of the invention, a compact cartridge 10 is achieved by arranging the arms 226 to enter a channel 236 formed in the core 38. It will be appreciated that upon returning the arms 226 from the clamp position to the load position, the resilient blades 82 are released to urge the reels 40 and 44 toward the cover 22 for restraining movement.

Figure 6:
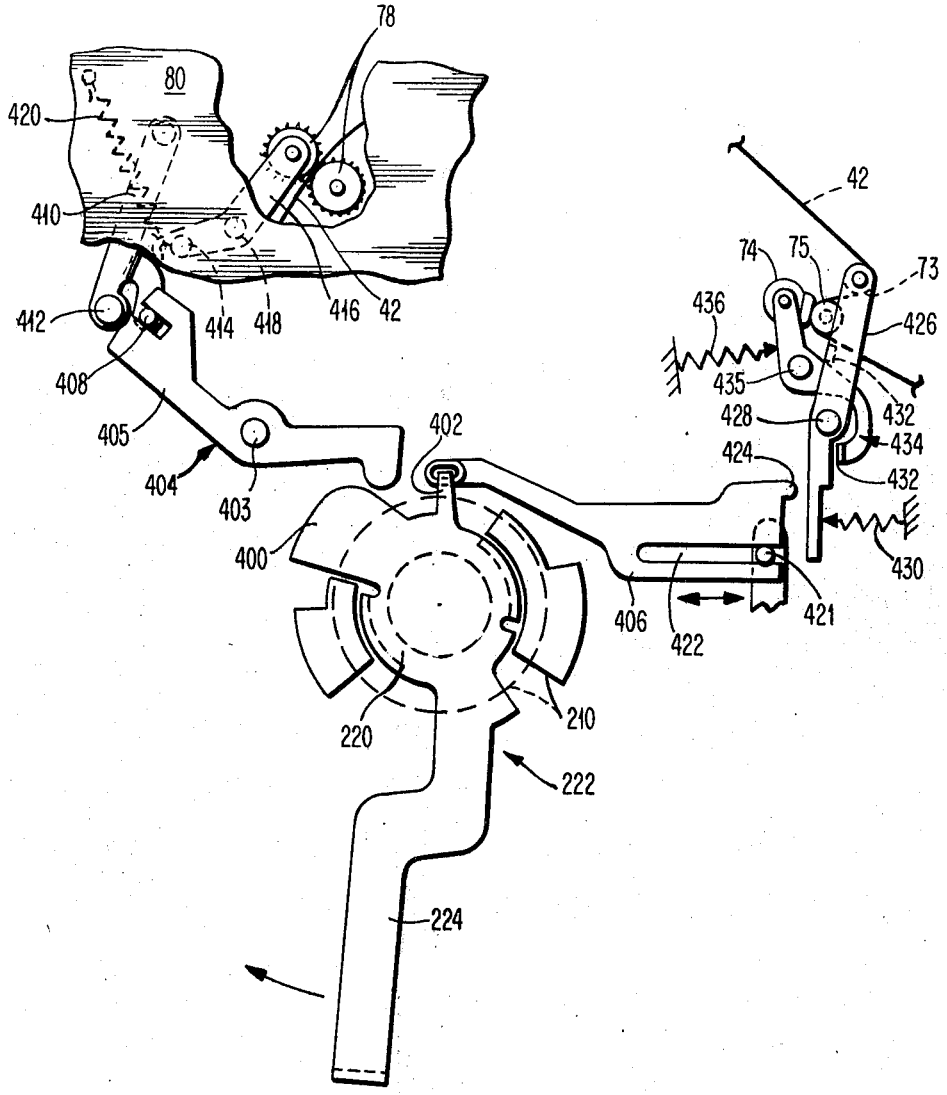
FIG. 6 is a simplified view taken from under the support for the cartridge and serves to emphasize linkages to the load lever that serve to drive ribbon nipping devices to withdrawn positions to facilitate ribbon insertion.

For a further aspect of the invention that is best understood with reference to FIG. 6, the loading member 224 is provided with a cam projection 400 and a bent tab 402 for coupling motion to linking members 404 and 406 to be used in opening nip points that occur along the path for the ribbon 42. Rotation of the loading member 224 causes the link member 404 to rotate counterclockwise (as viewed) about the pivot pin 403 to couple motion through a fork section 405 to the pin 408 mounted to a linking member 410, thereby causing rotation about a pivot pin 412. Such rotation about pivot pin 412 results in contact with a pin 414 to drive a pivot arm 416, supported at pivot pin 418, counter-clockwise (as viewed) against the biasing force of a spring 420. (Note the flange 210 has been cut away to better illustrate the loading member 224.)

The pivot pins 403, 412 and 418 are mounted to the support frame 80 (shown cutaway). Attached to pivot member 416 to extend above support frame 80 is one of the drive rollers 78 (see FIG. 1) and the motion transmitted from the cam projection 400 causes the drive rollers 78 to separate, thereby facilitating ribbon threading as the cartridge 10 is loaded.

The linking member 406 is moved by the bent tab 402 along a path defined in part by a pin 421 that is mounted to the support frame 80 and is arranged in a guide slot 422. A finger 424 engages a pivot member 426 that pivots about a pivot pin 428 and provides force opposite the bias of a spring 430 to cause counter-clockwise rotation (as viewed). This motion is transmitted to a pivot member 434 through a set of bent tabs 432 to cause rotation about a pin 435 against the bias of a spring 436. Motion transmitted by the linking member 406, when the loading member 222 is transferred to the load position, separates the brake member 74 and the pressure roller 75. Such separation facilitates threading of the ribbon 42 during loading and shifts the shock roller 73 to come within the opening 68 (see FIG. 1).

The invention has been described in detail with reference to a presently preferred implementation thereof. It will be appreciated, however, that variations and modifications within the scope of the claimed invention will be suggested to those skilled in the art.

For example, the invention could be adapted to various kinds of printers and both moveable printhead carrier printers or moveable platen printers may use the invention.

Also, the ribbon could be an ink ribbon or a lift-off tape or possibly a magnetic tape.

What is claimed is:

1. A cartridge for printer ribbon comprising:

first and second ribbon reels arranged to have a common rotational axis;

a container for said reels having a cover portion and a base portion including a generally flat floor that is opposite said cover portion, and a sidewall extending to receive said cover section, said first reel being arranged toward said floor and said second reel being arranged toward said cover;

resilient means, arranged to project from said floor, for engaging said first reel and for urging said first reel toward said second reel and said cover; and means defining at least one access aperture in said base portion to permit interaction with said resilient means from outside said container.

2. A cartridge according to claim 1 wherein said first reel is a supply reel for a ribbon and said second reel is a takeup reel and a ribbon path is defined to extend from said supply reel through a first aperture in said sidewall then externally of said container and back through a second aperture to said takeup reel.

3. A cartridge according to claim 1 wherein said resilient means comprises at least one resilient blade extending from said floor into said container and toward the axis of said reels to engage said first reel at a core section thereof.

4. A cartridge according to claim 3 wherein there are two resilient blades arranged on opposite sides of said reel axis.

5. A cartridge according to claim 1 wherein said second reel has a side toward said cover portion of said container that includes projecting means for engaging said cover portion of said container to resist relative motion.

6. A cartridge according to claim 5 wherein said projecting means is a circular ridge with asymmetrical triangular projections and said cover includes corresponding projections whereby relative rotational motion in one direction is resisted more strongly than for the other direction when said projections are urged into contact.

7. A ribbon loading system for a printer comprising:

a cartridge including first and second reels arranged coaxially within a container, said container including a base section and a cover, said first reel being toward a floor portion of said base section and said second reel being toward said cover;

resilient means projecting from said base section for engaging said first reel and for urging said first and second reels toward said cover;

means defining an access aperture in said base section for accessing said resilient means;

a support for receiving said cartridge;

an operator manipulable load member mounted to said support and including at least one cam arm arranged for entering said access aperture and being moveable for pressing against said resilient means to release said first reel from the urging thereof.

8. A ribbon loading system according to claim 7 wherein said load member is a rotatable load lever that is moveable to a clamping position in which a cam edge of said cam arm drives said resilient means away from said first reel.

9. A ribbon loading system according to claims 7 or 8 wherein said resilient member is a narrow blade molded integrally with a floor portion of said base section to extend within said container.

10. A ribbon loading system according to claim 8 wherein said load lever is coupled through linkages to move ribbon nipping and guiding members mounted on said support along a ribbon threading path.

11. A ribbon loading system according to claim 7 wherein said resilient means is two resilient blades arranged on opposite sides of the axis of said reels and there are two cam arms that are rotatable to press against said blades.

12. A ribbon loading system according to claim 11 wherein said cam arms project into a channel formed in a core of said first reel.

13. A ribbon loading system according to claim 7 wherein said second reel includes projections on a side adjacent said cover to prevent relative movement when urged thereagainst.

14. A ribbon loading system according to claim 13 wherein said projections are asymmetrical and cooperates with corresponding projections of said cover to resist rotational motion in one direction more strongly than motion in the other direction.

15. A ribbon cartridge for a printer comprising:

a container having a cover portion that includes inner surface irregularities and a base that defines a drive aperture for receiving a drive spindle;

a first reel and a second reel that are coaxially arranged in relation to said drive aperture with said second ribbon reel being toward said cover;

a ribbon extending between said first and second ribbon reels;

means, associated with said base, for providing a bearing surface for rotation of said first reel;

said second reel having irregularities at one surface arranged for interference with said surface irregularities of said cover when proximate thereto;

biasing means arranged within said container to urge said first and second reels toward said cover for causing interference engagement between said cover irregularities and said second reel irregularities;

means for defining at least one access opening in said base to permit interaction for relaxing said biasing means from said first and second reels whereby said reels may be released for rotation.

16. A ribbon cartridge according to claim 15 wherein said cover irregularities and said second reel irregularities are asymmetrical triangular projections.

17. A ribbon cartridge according to claim 16 wherein said biasing means is a pair of resilient blades formed in said base and extending to engage said first reel.

18. A ribbon mounting arrangement for a printer comprising:

a support member;

a drive spindle projecting from said support member;

a ribbon cartridge receivable on said support member including, a container having a cover that includes inner surface irregularities and a base that defines a drive aperture for receiving said drive spindle, a first ribbon reel and a second ribbon reel that are coaxially arranged respective of said drive aperture with said second ribbon reel being toward said cover, means, associated with said base, for providing a bearing surface for rotation of said first reel;

said second reel having irregularities at a surface arranged for interference with said irregularities of said cover when proximate thereto;

biasing blades arranged within said container to urge said first and second reels toward said cover for causing interference engagement between said cover irregularities and said first reel irregularities;

means for defining at least one access opening in said container; and a load member mounted to said support member for movement between a load position and a clamp position, said load member being connected to at least one projecting arm that for the load position of said load member is arranged to enter said access opening and, upon a transfer to the clamp position, deflects said biasing blades whereby said reels are released for movement.

* * * * *